US007530863B2

(12) United States Patent
Ito et al.

(10) Patent No.: US 7,530,863 B2
(45) Date of Patent: May 12, 2009

(54) ELECTRONIC REMOTE CONTROL SYSTEM OF A PROPULSION SYSTEM FOR A WATERCRAFT AND A WATERCRAFT

(75) Inventors: Makoto Ito, Shizuoka-ken (JP); Takashi Yamada, Shizuoka-ken (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 82 days.

(21) Appl. No.: 11/694,609

(22) Filed: Mar. 30, 2007

(65) Prior Publication Data

US 2008/0026653 A1 Jan. 31, 2008

(30) Foreign Application Priority Data

May 19, 2006 (JP) ..... 2006-140538

(51) Int. Cl.
*B63H 21/22* (2006.01)

(52) U.S. Cl. ..... 440/1; 440/86

(58) Field of Classification Search ..... 440/1, 440/84, 86, 87

See application file for complete search history.

(56) References Cited

U.S. PATENT DOCUMENTS 5,235,951 A * 8/1993 Taguchi et al. ..... 123/397
6,280,269 B1 8/2001 Gaynor
2005/0164569 A1* 7/2005 Kaji et al. ..... 440/1

* cited by examiner

*Primary Examiner*—Stephen Avila
(74) *Attorney, Agent, or Firm*—Knobbe Martens Olson & Bear LLP

(57) ABSTRACT

An engine electronic remote control system is provided that can include an engine electronic control unit for controlling an operating state of the engine and a remote controller having a control lever capable of transmitting a control signal to the engine electronic control unit to achieve a target operating state. The system can comprise an operating state determination subsystem, a shift actuator, a shift position detector, and a lever position detector. In an embodiment, the shift actuator can drive a shiftable component to a neutral when a main switch being switched on is switched off while the control lever is in a position other than a neutral position.

16 Claims, 5 Drawing Sheets

ELECTRONIC REMOTE CONTROL SYSTEM OF A PROPULSION SYSTEM FOR A WATERCRAFT AND A WATERCRAFT

CROSS-REFERENCE TO RELATED APPLICATIONS

The present application is based on and claims priority under 35 U.S.C. § 119 to Japanese Patent Application No. 2006-140538, filed on May 19, 2006, the entire contents of which is expressly incorporated by reference herein.

BACKGROUND

1. Field of the Inventions

The present inventions generally relate to an electronic remote control system of an internal combustion engine for a watercraft.

2. Description of the Related Art

Propulsion systems used for watercraft are conventionally operated using remote controls. For example, the shift and throttle operations of a propulsion system, such as an outboard motor, can be remotely controlled using a control lever of a remote controller provided in a steering console of the watercraft.

Such a remote control system is usually only configured to conduct the shift and throttle operations. For example, the shift operation is conducted with a throttle valve completely closed or in a so-called shifting range. The shifting range typically falls within a predefined range that generally defines a neutral position of a control lever. The throttle valve operation includes opening and closing of a throttle valve, for example, from a completely closed state to a full throttle state. The throttle operation is typically conducted with a shift state being maintained while in a so-called throttle range, which is a range beyond the above predefined shifting range of the control lever. In other words, the shift lever can move within a first range to control shifting and a broader second range to control the throttle.

The propulsion force of a small watercraft can be increased by installing two or three outboard motors on the stern. This modification can enable the watercraft to continue to operate even in the event of one motor failure. In addition, the watercraft can have a main steering console that is positioned at a center part of a watercraft, and an upper steering console that is positioned in a position higher than that of the main console. This configuration can provide a fine view, and is often integrated into a dual station type electronic remote control system. Such a system includes different remote controllers, which are connected to an electronic control unit of one or more of the outboard motors, and positioned in each of steering consoles to operate an outboard motor that can be installed far from a main steering console and an upper steering console (see, e.g., U.S. Pat. No. 6,280,269).

SUMMARY

Unlike prior remote control systems, embodiments of an electronic remote control system described herein do not need heavy, bulky parts, such as throttle and shift cables, which are used to interconnect the control lever with a detection lever of a potentiometer of an electronic control unit installed on the outboard motor. These advantages, as well as others discussed herein, can make a watercraft lighter, increase cabin space in the watercraft, and simplify its assembly.

In case of a mechanical type remote control system, a shift of an outboard motor is engaged and released regardless of whether electrical power is supplied to the remote controller. This occurs because a control lever's shift cable will extend and retract as actuated by the user of a remote controller regardless of whether electrical power is present, and such mechanical action occurs independent of any supply of electric power to the remote controller. Therefore, when a main switch, which is already switched on, is switched off during normal navigation in order to stop operation of an internal combustion engine, some embodiments of the present inventions make it possible to continue normal navigation without having to return a control lever to a neutral position before restarting the engine and engaging a shift.

With respect to the conventional remote control systems, the engine may not operate as desired after a supply of the electric power from a power source to a remote control system is interrupted due to a connection failure in an electrical system or others during a normal navigation, which causes rotation of the engine to stop. In such situations, once the electric power is supplied to the engine again, a lever position detector will detect that the control lever is not in a neutral position and a shift of the outboard motor will be engaged. Therefore, in conventional systems, when trying to restart the engine under such conditions, the engine can experience abrupt starting and the associated loading with a shift of the engine engaged.

To solve this problem of conventional remote control systems described above, an aspect of at least one embodiments disclosed herein provides an electric remote control system for preventing an undesired shifting behavior from occurring when the electric power is interrupted and resupplied to the engine with the control lever being in a position other than neutral. Further, embodiments of the present inventions can be included in watercraft or other vehicles, as desired.

Accordingly, an embodiment of an electronic remote control system of an engine for a watercraft comprises an internal combustion engine electronic control unit, a remote controller, an operating state determination means, a shift actuator, a shift position detector, and a lever position detector. The engine electronic control unit can control an operating state of an internal combustion engine. The remote controller can have a control lever capable of transmitting a control signal to the engine electronic control unit in order to achieve a target operating state. The electronic remote control system can include the operating state determination means for determining whether the internal combustion engine is in an operating state. The shift actuator can be capable of causing a shift according to a target shift position set with the control lever. The shift position detector can detect whether the shift actuator and/or transmission is in neutral. The lever position detector can detect whether the control lever is in a neutral position. In addition, the shift actuator can be controlled to cause a shift to a neutral state when a main switch that has been in an on position is subsequently switched off while the control lever is in a position other than a neutral position.

In another embodiment, the shift actuator can be controlled to keep the shift state in neutral by detecting an engine rotational speed reaching or becoming lower than a predefined rotational speed after a main switch that has been in an on position is subsequently switched off while the control lever is in a position other than a neutral position.

Another embodiment of the electronic remote control system can be configured to include an internal combustion engine electronic control unit for controlling an operating state of an internal combustion engine and a remote controller having a control lever capable of transmitting a control signal to the engine electronic control unit to achieve a target operating state. The electronic remote control system can comprise an operating state determination means, a shift actuator, a shift position detector, and a lever position detector. The operating state determination means can determine whether the engine is in an operating state. The shift actuator can be capable of driving a shift state according to a target shift position set with the control lever. The shift position detector can detect whether the shift state is neutral. The lever position detector can detect whether the control lever is in a neutral position. The shift actuator can be controlled to drive the shift state to neutral when a main switch being switched off is switched on while the control lever is in a position other than a neutral position.

Some of the embodiments disclosed herein can release a control state and recover a normal control state to follow an operation of the control lever when the control lever is set in a neutral position.

In another embodiment, the electronic remote control system can be configured such that the shift actuator can be controlled to maintain a normal control state following an operation of the control lever when the engine returns to an operating state with a restarted power supply after a supply of the electric power from a power source to the electronic remote control system is interrupted and the engine stops driving while the control lever is in a position other than a neutral position.

In yet another embodiment of the electronic remote control system, the shift actuator can be controlled to maintain the transmission in neutral even if an operation lever is incorrectly operated and set in a position other than a neutral position when a supply of the electric power is restarted and the internal combustion engine returns to an operating state after a supply of the electric power from a power source to the electronic remote control system is interrupted and the internal combustion engine stops driving while the control lever is in a neutral position and an internal combustion engine is idling.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

The following is a description of embodiments that are arranged and configured in accordance with certain features, aspects and advantages of the present inventions. This description makes reference to FIGS. 1-5. As shown therein, FIGS. 1-5 illustrate an embodiment of an outboard motor comprising an electronic remote control system. The embodiments disclosed herein are described in the context of a marine propulsion system of a watercraft because these embodiments have particular utility in this context. However, certain features, aspects and advantages of the embodiments can also be applied to other marine vessels, personal watercraft, boats, such as small jet boats, as well as other land and marine vehicles. It is to be understood that the embodiments disclosed herein are exemplary but non-limiting embodiments, and thus, the inventions disclosed herein are not limited to the disclosed exemplary embodiments.

Figure 1:
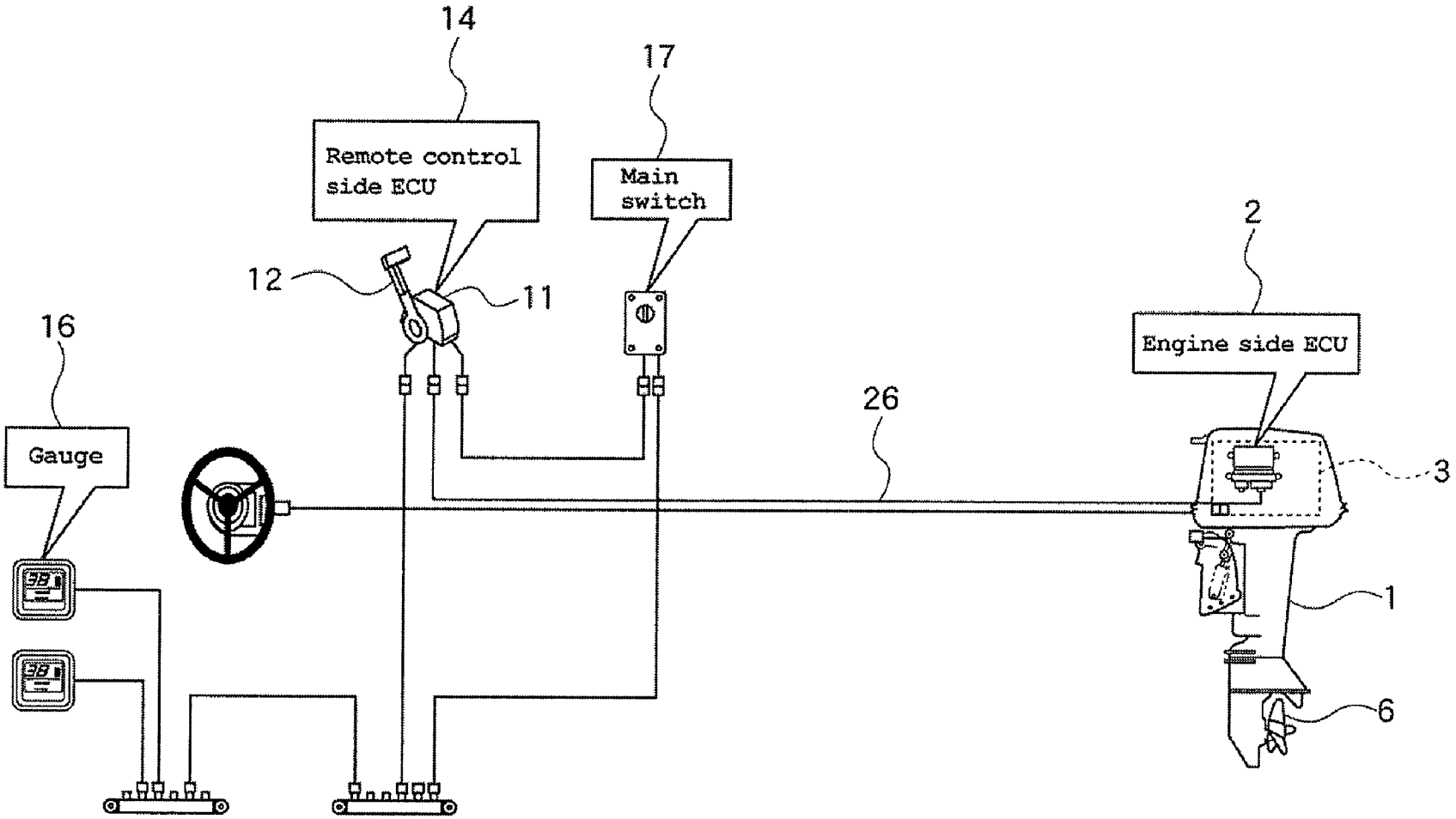
FIG. 1 is a diagram showing a structure of an electronic remote control system, according to an embodiment of the present inventions.
Figure 2:
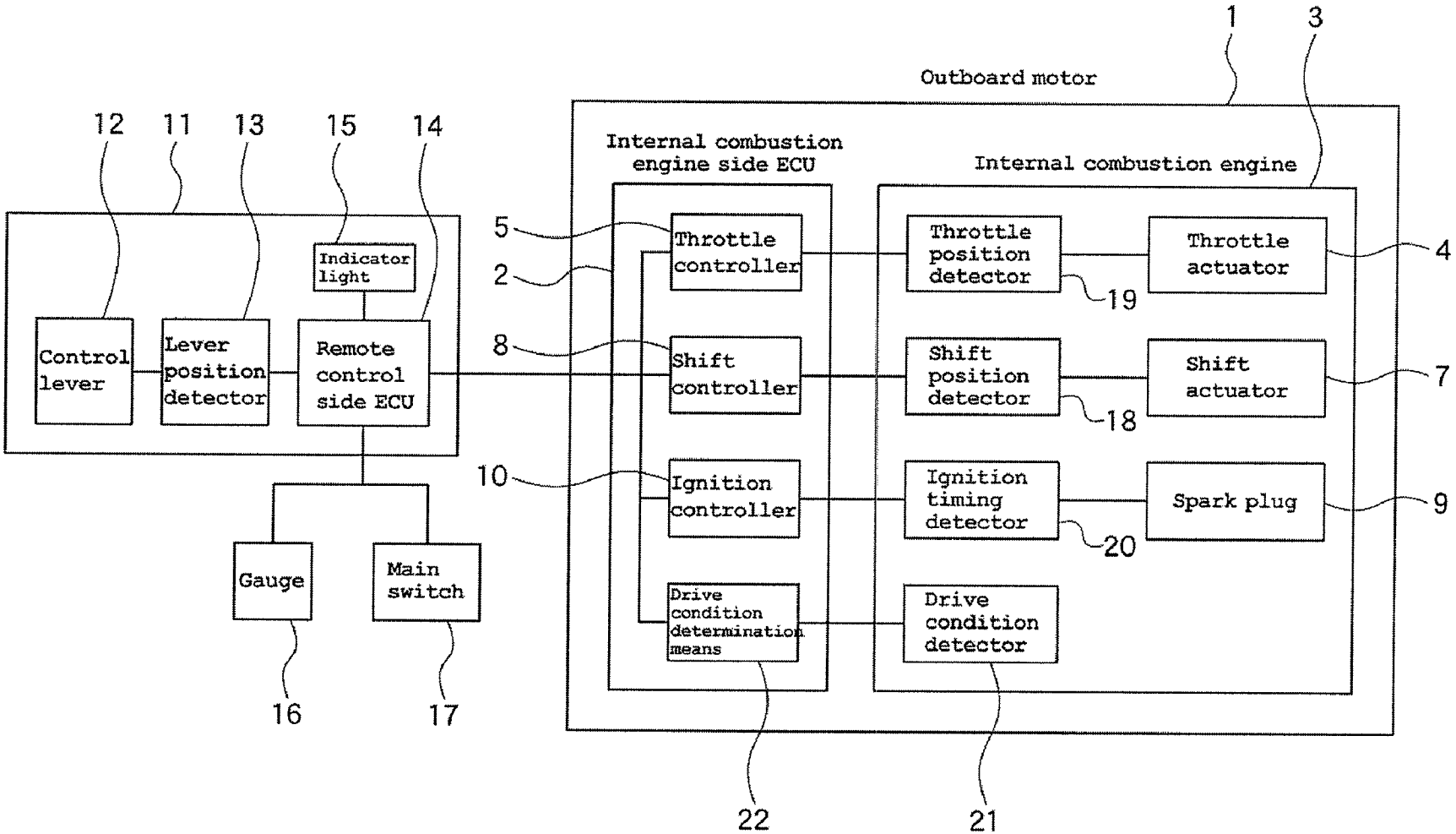
FIG. 2 is a function block diagram of the system, according to another embodiment.

FIG. 1 is an exemplary structure of an electronic remote control system, according to an embodiment of the present inventions, and FIG. 2 is a block diagram of the system in accordance with another embodiment. As shown therein, an electronic control unit 2 can be provided on the internal combustion engine side (i.e., can be provided in the outboard motor 1). As shown in FIG. 2, the electronic control unit 2 can be configured to include a throttle controller 5, a shift controller 8, and an ignition controller 10. The throttle controller 5 can be operative to control an operation of a throttle actuator 4 and to determine an operation state of the internal combustion engine 3 in the outboard motor 1. The shift controller 8 can be operative to control an operation of a shift actuator 7 and to engage or release a shift to switch drive power from the internal combustion engine 3 to a forward rotation or a reverse rotation of the propeller 6 disposed on the outboard motor 1. Finally, the ignition controller 10 can be operative to control an ignition timing of a sparking plug 9.

As illustrated in FIG. 1, a remote controller 11 can be configured to include a control lever 12 for operating a gear shift and throttle. The lever 12 can be pivotably provided in the remote controller 11. FIG. 2 illustrates that the remote controller 11 can also include a lever position detector 13, which can be capable of detecting a rotational position of the control lever 12. Additionally, an operation state (or operation position) can be sequentially detected by the lever position detector 13. A lever position signal corresponding to the detected value can be sent to the electronic control unit 2 via an electronic control unit 14, which can also be included in the remote controller 11, as shown in FIG. 2.

In accordance with another embodiment, the remote controller 11 can also include an indicator light 15 for indicating a shift position of the outboard motor 2. In addition, a gauge 16 can be connected to the remote control side electronic control unit 14 of the remote controller 11 for confirming an operation state of the internal combustion engine 3, such as a rotational speed of the internal combustion engine 3 and the oil temperature, for example but without limitation. Further, the electronic control unit 14 can also be connected to a main switch 17 for supplying or interrupting electricity from a power source.

With reference again to FIG. 2, the shift controller 8 of the electronic control unit 2 can send a shift control signal to control an operation of the shift actuator 7 according to an operation state (operation position) of the control lever 12. A movement of the shift actuator 7 can be monitored by the shift position detector 18, and, as a result, a shift position signal can be sent to the shift controller 8 as feedback to indicate a shift position such as "forward," "neutral," and "reverse." To achieve similar feedback control for the throttle controller 5 and the ignition controller 10, the engine 3 can include a throttle position detector 19 for detecting an operation state of the throttle actuator 4 and an ignition timing detector 20 for detecting an operation state of the spark plug 9. In this regard, the throttle position detector 19 can be connected to the throttle control device 5, and the ignition timing detector 20 can be connected with the ignition control device 10.

The engine 3 can include an operating condition detector 21 that can be installed to detect whether a drive shaft connected to a crankshaft of the internal combustion engine 3 is being rotated or not. In addition, the operating condition detector 21 can include and/or be connected to other detectors in order to detect any abnormality in an operating state, such as overheating and oil reduction; such exemplary detectors could include an overheat detector and an oil reduction detector (e.g., an oil level sensor), to name a few. Further, the engine 3 can include an operating condition determination device 22 that can be connected with the electronic control unit 2 in order to determine whether the internal combustion engine 3 is in an operating state according to a signal from the operating condition detector 21.

Figure 3:
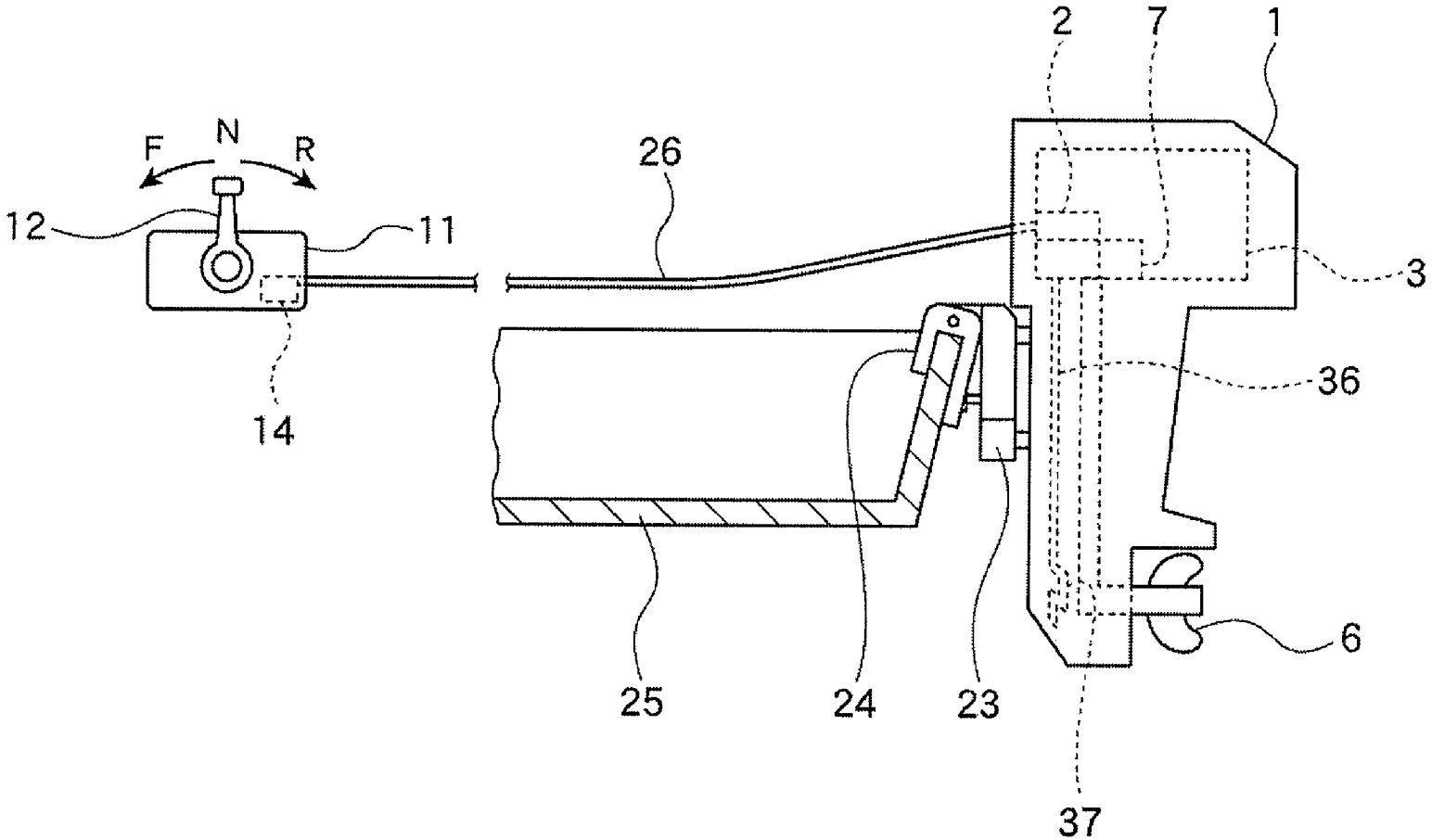
FIG. 3 is a diagram showing structure of a drive operation system of a gear shift of the system, according to yet another embodiment.

FIG. 3 is a structure of a drive operation system of a gear shift of an electronic remote control system, according to another embodiment of the present inventions. As shown in FIG. 3, the outboard motor 1 can be mounted to a hull 25 with a bracket 23 and a clamp bracket 24. A remote controller 11 having a control lever 12 can be arranged in the vicinity of a steering console. An electronic control unit 14 associated with the remote controller 11 can be electrically connected with an electronic control unit 2 on an internal combustion engine side via a network cable 26.

Figure 4:
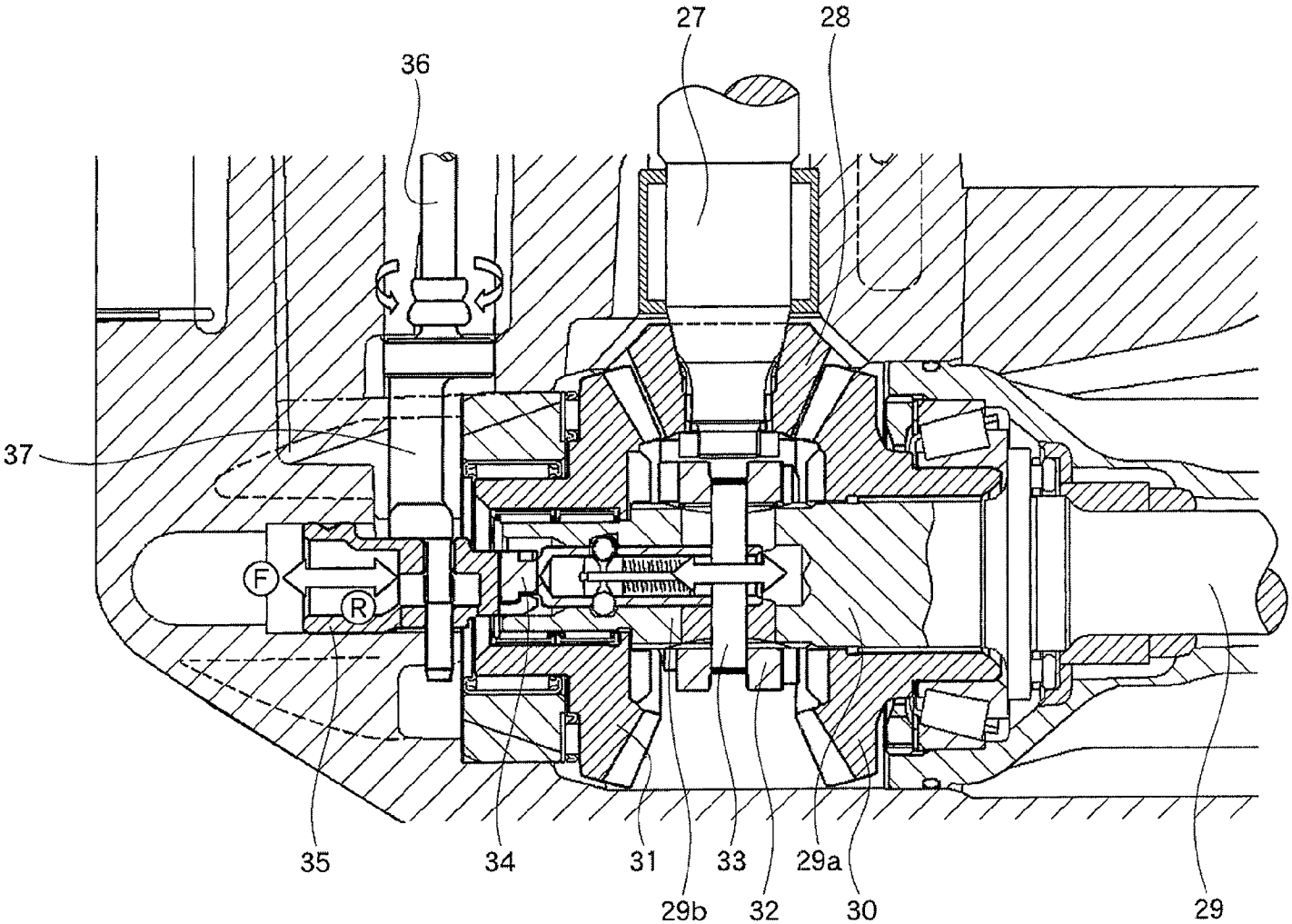
FIG. 4 is a partial cross-sectional view showing a main part of a power transmission mechanism in an outboard motor of a watercraft having an electronic remote control system, according to yet another embodiment.

FIG. 4 illustrates a partial cross-sectional view of a drive power transmission mechanism in an outboard motor 1. A crank shaft (not shown) of the internal combustion engine 3 can be arranged with its axis being oriented in a generally vertical direction, and a drive shaft 27 can be connected to its end. A pinion 28 can be fixed to the bottom end of the drive shaft 27. In addition, a propeller shaft 29, which can be connected with the propeller 6, can be oriented orthogonally relative to the drive shaft 27. The forward gear 30 and the reverse gear 31 can be disposed on the propeller shaft 29. Each of the forward gear 30 and the reverse gear 31 can engage with the pinion 28 to rotate in opposite directions from each other. The dog clutch 32, which can slide in an axial direction relative to the propeller shaft 29, can be disposed between the forward gear 30 and the reverse gear 31. The dog clutch 32 can be configured to engage with either of the forward gear 30 or the reverse gear 31, as needed.

FIG. 4 illustrates the power transmission in a neutral state, in which the dog clutch 32 does not engage either of the forward gear 30 or the reverse gear 31. In some embodiments, the propeller shaft 29 can comprise a rear shaft 29*a* and a front shaft 29*b*. The dog clutch 32 can be connected via spline connection with the front shaft 29*b* of the propeller shaft 29. Thus, the dog clutch 27 can slide in the longitudinal or axial direction of the propeller shaft 29 while in splined connection with the front shaft 29*b* to facilitate rotation thereof with the propeller shaft 29.

The dog clutch 32 can be connected with a slider 34, which can slide in the axial direction of the propeller shaft 29 with the crossing pin 33. The slider 34 can be configured with a front head end connected with a shifter 35 to facilitate rotation. The shifter 35 can be connected by a cam linkage with a cam 37. The cam 37 can be coupled to a bottom end of the shift lever 36. When the shift lever 36 is rotated around the axis to rotate the cam 37, the shifter 35 can move to the front (F) or to the rear (R) accordingly. Thus, the shifter 35 can slide back and forth to cause the dog clutch 32 to engage with either of the forward gear 30 or the reverse gear 31. In this manner, a rotation of the pinion 28 can be transmitted to the front shaft 29*b* as a rotational force in the forward direction or in the reverse direction. Subsequently, the rotational force transmitted to the front shaft 29*b* is passed to the rear shaft 29*a* which can be coupled thereto.

Figure 5:
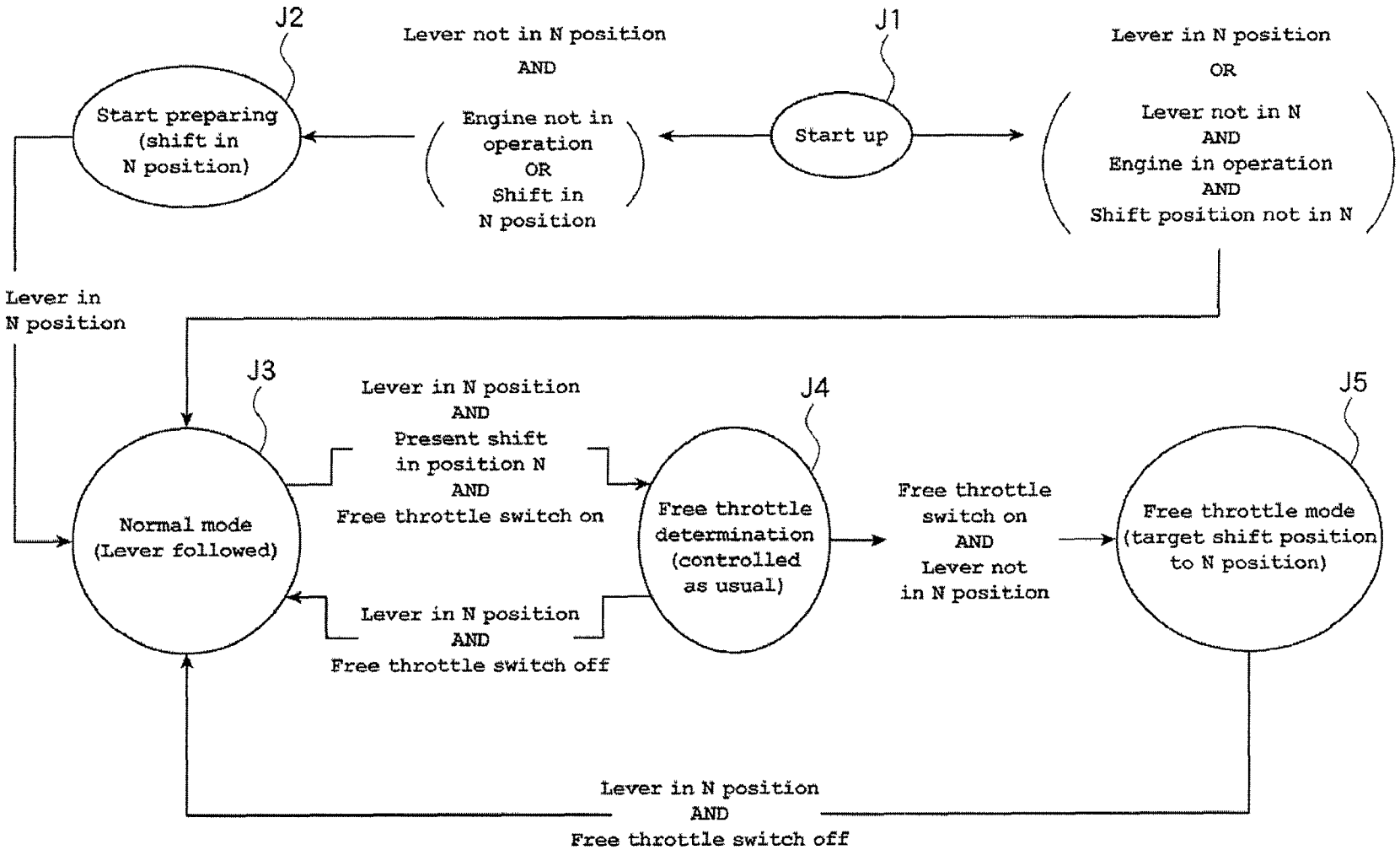
FIG. 5 shows a state transition of an electronic remote control system, according to yet another embodiment.

FIG. 5 illustrates a state transition diagram of an action of an electronic remote control system, according to an embodiment that is arranged and configured in accordance with certain features, aspects and advantages of the present inventions. In accordance with such an embodiment, the engine 3 can include an operating condition detector 21 that can detect an operating state of the engine 3 and can transmit the result to the electronic control unit 2. Based on a signal from this operating condition detector 21, the operating condition determination device 22 can determine whether the engine 3 is operating. The shift detector 18 can detect where a shift position of the engine 3 is set, and transmit the result to the electronic control unit 14 via the electronic control unit 2, for example.

Additionally, the lever position detector 13 can detect the position of the control lever 12, and transmit the result to the electronic control unit 14, for example. In other words, information on whether the engine 3 is operating, information on a shift position, and information on a position of a control lever can be input to the electronic control unit 14. Based on the information, an arithmetic unit (not shown), for example, in the electronic control unit 14 can execute an operation. According to the operation result, a control signal then can be transmitted to the shift controller 8 to indicate whether a shift position of the engine 3 is changed or maintained.

In an embodiment, the electronic control unit 14 can proceed from a start up state J1 to a start preparation state J2 if it determines that a startup is being prepared. For example, once the ECU 14 enters the startup state J1, in which the main switch 17 is turned on, the ECU 14 can determine if the control lever 12 is in a position other than a neutral position and the engine 3 is not in an operating state (e.g., where the engine 3 is kept stopped). If these conditions are met, the ECU can proceed to state J2. Next, the ECU 14 can proceed from state J2 to normal mode J3 if a transmission of the engine 3 is maintained in a neutral position and the lever is in the neutral position. After entering the normal mode state J3, the ECU 14 is set to follow an operation of the control lever 12.

In another implementation, the ECU 14 can proceed from start up state J1 to state J2 if the control lever 12 is in a position other than a neutral position and a transmission associated with the engine 3 is maintained in a neutral position. Then, if the lever 12 is in the neutral position, the normal mode state J3 can be entered and the ECU 14 can be set to follow an operation of the control lever 12.

In another embodiment, the ECU 14 can proceed from state J1 to state J3 when the control lever 12 is in a neutral position, the normal mode state J3 is set to follow an operation of the control lever 12.

In yet another embodiment, the ECU 14 can proceed from state J1 to state J3 when the control lever 12 is in a position other than a neutral position, the engine 3 is in an operating state, and a transmission associated with the engine 3 is in a position other than a neutral position. Accordingly, the normal mode state J3 can be entered and the ECU 14 can be set to follow an operation of the control lever 12.

Once the ECU 14 enters state J3, it can proceed to state J4 when the control lever 12 is in a neutral position, a transmission associated with the internal combustion engine 3 is in a neutral position, and a free throttle switch is turned on. In state J4, the presence of a free throttle state can be determined. As a result, if a free throttle switch is on and the control lever 12 is in a position other than a neutral position, then the transmission is set in a neutral position and the idling mode state J5 is set.

While in the idling mode state J5, when the control lever 12 is in a neutral position and a free throttle switch is off, the ECU 14 can be set to the normal mode state J3 to follow an operation of the control lever 12.

According to the processes as described above, the control lever 12 is operated from a neutral position (N) to a forward side (F) or a reverse side (R). The lever position detector 13 can read the lever position, and a lever position signal corresponding to the lever position can be transmitted to the shift controller 8 of the electronic control unit 2 on an internal combustion engine side via the electronic control unit 14 on a remote control side. The shift controller 8 can send a shift control signal corresponding to an operation state (i.e. operation position) of the control lever 12 to the shift actuator 7. The shift actuator 7 can conduct a shifting operation according to a received shift control signal, and can switch a foreword rotation and a reverse rotation of the propeller 6 by rotating the shift lever 36 of the engine 3 around the axis. In a similar manner, when the control lever 12 is operated from a forward side (F) or a reverse side (R) to a neutral position (N), a shift operation can be carried out to maintain a neutral position such that the propeller 6 is not rotated.

In accordance with an embodiment of the electronic remote control system, abrupt starting of the watercraft can be avoided. For example, the system can be configured to control the shift actuator 7 to drive a shift position of the engine 3 to neutral if the main switch 17 being switched on is switched off during a navigation and the control lever 12 is in a non-neutral position. In such a situation, it is possible that abrupt starting of the watercraft could occur when trying to restart the engine after a supply of the electric power from a power source to an electronic remote control system has been interrupted due to a connection failure in an electrical system or others, and a shift is set in a neutral position and a rotation of the internal combustion engine 3 has been stopped. Accordingly, embodiments disclosed herein prevent abrupt starting of the watercraft because when the electric power is supplied again to start the internal combustion engine 3, a rotational force of the internal combustion engine 3 is not transmitted to the propeller 6 as long as an operator does not act to operate the control lever 12 to engage a shift. Therefore, a watercraft would not abruptly start.

In addition, the shift actuator 7 can be configured to maintain the shift position in neutral by detecting an engine rotational speed reaching or becoming lower than a predefined rotational speed after the main switch being switched on is switched off when the control lever 12 is in a position other than a neutral position. Such an embodiment can tend to reduce a load on the shift actuator 7.

Abrupt starting of the watercraft can also be avoided because the shift actuator 7 can be controlled to maintain a shift position in neutral if the main switch 17 being switched off is switched on and the control lever 12 is in a position other than a neutral position during navigation. Accordingly, because a shift is maintained in a neutral position, after a supply of the electric power from a power source to an electronic remote control system is interrupted due to a connection failure in an electrical system, for instance, and rotation of the internal combustion engine 3 stops, abrupt starting is avoided when the electric power is supplied again to rotate the internal combustion engine 3. In this regard, as mentioned above, a rotational force of the internal combustion engine 3 would not be transmitted to the propeller 6 as long as an operator does not act to operate the control lever 12 to engage a shift. In such an embodiment, the watercraft does not abruptly start.

Additionally, it is contemplated that the time required to resume an operation can be minimized after switching off the main switch 17. For example, when the control lever 12 is set in a neutral position, a control to maintain a shift position of the engine 3 in neutral can be released, thus allowing the shift actuator 7 to be controlled to recover to a normal control state and to thereby follow an operation of the control lever 12. Accordingly, a normal control state can be recovered when the control lever 12 is set in a neutral position, even after a supply of the electric power from a power source to an electronic remote control system is interrupted due to a connection failure in an electrical system, for instance, and a rotation of the internal combustion engine 3 stops. In this regard, when the electric power is supplied again to rotate the engine, an operator need only return the control lever 12 to a neutral position to be able to operate and/or navigate the watercraft. This saves time to resume an operation by switching off the main switch 17 that has been switched on.

In addition, navigation of the watercraft can be continued without any indication of unusual operation. For example, in a situation where a supply of the electric power from a power source to an electronic remote control system is interrupted and the internal combustion engine 3 stops, and later, the supply of the electric power is resumed in order to return the engine 3 to an operating state, but the control lever 12 is in a position other than a neutral position, the shift actuator 7 can be controlled to maintain a normal control state to follow an operation of the control lever 12. The shift actuator 7 can be controlled and remain engaged even when a power source is momentarily interrupted due to an accident of a connection failure or due to reset of the electronic remote control system. Therefore, engine operation will not seem unusual when navigating during such circumstances.

Further, some embodiments provide that during unexpected stops of the engine, the rotational force of the internal combustion engine 3 can be controlled such that it is not transmitted to the propeller 6 immediately after the engine 3 returns to an operating state. For example, the control lever 12 can be in a neutral position and the engine 3 can be under an idling condition. Further, a supply of the electrical power from a power source to an electronic remote control system can be interrupted and the engine 3 can be stopped. When the supply of the electric power is started again and the engine 3 recovers to an operating state, the shift actuator 7 can be controlled to maintain a shift position of the engine 3 in neutral even if the control lever 12 is incorrectly operated at a position other than a neutral position. In this manner, the shift can be maintained in a neutral position. Therefore, in such an embodiment, a rotational force of the internal combustion engine 3 is not transmitted to the propeller 6 immediately after the internal combustion engine 3 returns to an operating state.

In accordance with another embodiment of an electronic remote control system, the electronic control unit 2 of the engine 3 and the electronic control unit 14 of the remote controller 11 can be linked to conduct a target control. In other embodiments, where the electronic control unit 14 is not used, the system can incorporate a function of the electronic control unit 14 into the electronic control unit 2.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An electronic remote control system of an internal combustion engine for a watercraft including an engine electronic control unit for controlling an operating state of the engine and a remote controller having a control lever capable of transmitting a control signal to the engine electronic control unit to achieve a target operating state, the system comprising:

an operating state determination subsystem that is capable of determining whether the engine is in an operating state;

a shift actuator capable of driving a shifting component according to a target shift position set with the control lever;

a shift position detector for detecting whether the shifting component is in neutral; and a lever position detector for detecting whether the control lever is in a neutral position, and wherein the shift actuator drives the shifting component to neutral when a main switch that was previously switched on is switched off while the control lever is in a position other than the neutral position and wherein the shift actuator maintains the shifting component in neutral when an engine rotational speed is lower than a predefined rotational speed after the main switch that was previously switched on is switched off while the control lever is in a position other than the neutral position.

2. The system of claim 1, wherein the system is capable of releasing a control state and recovering a normal control state to follow an operation of the control lever when the control lever is set in the neutral position.

3. A watercraft comprising the electronic remote control system of claim 1.

4. The system of claim 1, wherein the shift actuator is controlled to maintain a normal control state following an operation of the control lever when the internal combustion engine returns to operating with a restarted power supply after a supply of the electric power from a power source to the electronic remote control system is interrupted and the engine stops while the control lever is in a position other than the neutral position.

5. A watercraft comprising the electronic remote control system of claim 4.

6. The system of claim 1, wherein the shift actuator is controlled to maintain the shifting component in neutral when a supply of the electric power is restarted and the internal combustion engine returns to operating after a supply of the electric power from a power source to the electronic remote control system is interrupted and the internal combustion engine stops driving while the control lever is in the neutral position and the internal combustion engine is idling.

7. A watercraft comprising the electronic remote control system of claim 6.

8. The system of claim 1, wherein the shift actuator is configured to enter a control state in which the shift actuator maintains the shifting component in neutral.

9. The system of claim 8, wherein the shift actuator is released from the control state upon receiving a signal from the lever position indicator that the control lever is in the neutral position.

10. The system of claim 9, wherein the system is configured such that the shift actuator can be controlled by a control signal from the control lever after the shift actuator is released from the control state.

11. An electronic remote control system of an internal combustion engine for a watercraft including an engine electronic control unit for controlling an operating state of the engine and a remote controller having a control lever capable of transmitting a control signal to the engine electronic control unit to achieve a target operating state, the system comprising:

an operating state determination means for determining whether the engine is in an operating state;

a shift actuator capable of driving a shifting component according to a target shift position set with the control lever;

a shift position detector for detecting whether the shifting component is in neutral; and a lever position detector for detecting whether the control lever is in a neutral position, wherein the shift actuator is controlled to drive the shifting component to neutral when a main switch that previously was switched off is switched on while the control lever is in a position other than the neutral position and wherein the shift actuator maintains the shifting component in neutral when an engine rotational speed is lower than a predefined rotational speed after the main switch that previously was switched off is switched on while the control lever is in a position other than the neutral position.

12. A watercraft comprising the electronic remote control system of claim 11.

13. The system of claim 11, wherein the system is capable of releasing a control state and recovering a normal control state to follow an operation of the control lever when the control lever is set in the neutral position.

14. The system of claim 11, wherein the shift actuator is configured to enter a control state in which the shift actuator maintains the shifting component in neutral.

15. The system of claim 14, wherein the shift actuator is released from the control state upon receiving a signal from the lever position indicator that the control lever is in the neutral position.

16. The system of claim 15, wherein the system is configured such that the shift actuator can be controlled by a control signal from the control lever after the shift actuator is released from the control state.

* * * * *